United States Patent [19]

Perkins

[11] Patent Number: 4,798,176

[45] Date of Patent: Jan. 17, 1989

[54] APPARATUS FOR FRICTIONALLY HEATING LIQUID

[76] Inventor: Eugene W. Perkins, Rte. 1, Box 1837, Dawsonville, Ga. 30534

[21] Appl. No.: 81,312

[22] Filed: Aug. 4, 1987

[51] Int. Cl.[4] ..... F22B 3/06

[52] U.S. Cl. ..... 122/26; 126/247; 237/1 R

[58] Field of Search ..... 122/11, 12, 26; 126/247; 237/1 R; 165/90; 415/71, 120

[56] References Cited

U.S. PATENT DOCUMENTS

| | | | |
|---|---|---|---|
| 3,063,673 | 11/1962 | Johnson | 415/120 |
| 3,242,908 | 3/1966 | Kopczynski | 122/11 |
| 4,480,592 | 11/1984 | Gokcen | 122/26 |
| 4,596,511 | 6/1986 | Weihrib | 415/120 |
| 4,664,068 | 5/1987 | Kretchmari et al. | 122/26 |

*Primary Examiner*—Steven E. Warner

*Attorney, Agent, or Firm*—Scrivener and Clarke

[57] ABSTRACT

An impeller for frictionally heating liquid is arranged that upon rotation thereof in a liquid reservoir, liquid is forced from the exterior of the impeller through passages having restricted orifices therein to an inner outlet cavity closed on one side and having an axial opening on the other. The impeller not only heats the liquid due to the shear friction of the liquid with its outer surface, but the liquid flowing through these passages is further heated as it is forced through the orifices. The impeller serves both as a friction heater and a pump to circulate heated liquid through an outlet port in the housing to a heat utilization device and back to an inlet port.

7 Claims, 1 Drawing Sheet

APPARATUS FOR FRICTIONALLY HEATING LIQUID

FIELD OF THE INVENTION

This invention relates to liquid heating apparatus and more particularly to apparatus which heats liquid by friction.

BACKGROUND OF THE INVENTION

It is known to heat liquid by rotating a rotor in a reservoir of liquid, such an arrangement being shown in my U.S. Pat. No. 4,424,797. It is also known to frictionally heat a liquid byforcing it through restricted orifices such an arrangement being shown in the patent to Horne et al. U.S. Pat. No. 4,344,567.

A problem associated with rotating a rotor in a bath of liquid is that there can be a cavitation problem wherein the liquid periodically separates at the interface between the rotor and liquid. Further, where the heated liquid must be transported to a heat utilization device, such as a heat exchanger separate pump means must usually be provided.

SUMMARY OF THE INVENTION

The object of the present invention is to provide an impeller comprising a rotor rotatable in a reservoir of liquid to heat the same through frictional shear of liquid at the interface between the rotor and the liquid. The rotor has a peripheral surface and a central outlet cavity which has an opening on one side of the rotor while its other side is closed. Fluid passages extend from the peripheral surface of the rotor to the outlet cavity and the passages are arranged relative to the axis of rotation of the rotor that upon rotation thereof in a predetermined direction liquid is forced to flow from the peripheral surface into the outlet cavity. Restricted orifices are positioned in the passages to cause the liquid flowing therethrough to be further heated.

Another object of the invention is to provide the combination of an impeller of the foregoing nature and a closed housing defining a liquid reservoir and in which the impeller is rotatably mounted, the housing having an inlet port in radial alignment with the impeller rotor and an outlet port in axial alignment with the opening in the side of the outlet cavity whereby the rotor, by its outer surface and the restricted orifices not only serves as a liquid heater but it also serves as a pump to circulate the heated liquid through the outlet port and a heat utilization device, such as a heat exchanger, and back to the inlet port.

DETAILED DESCRIPTION OF THE INVENTION

Figure 1:
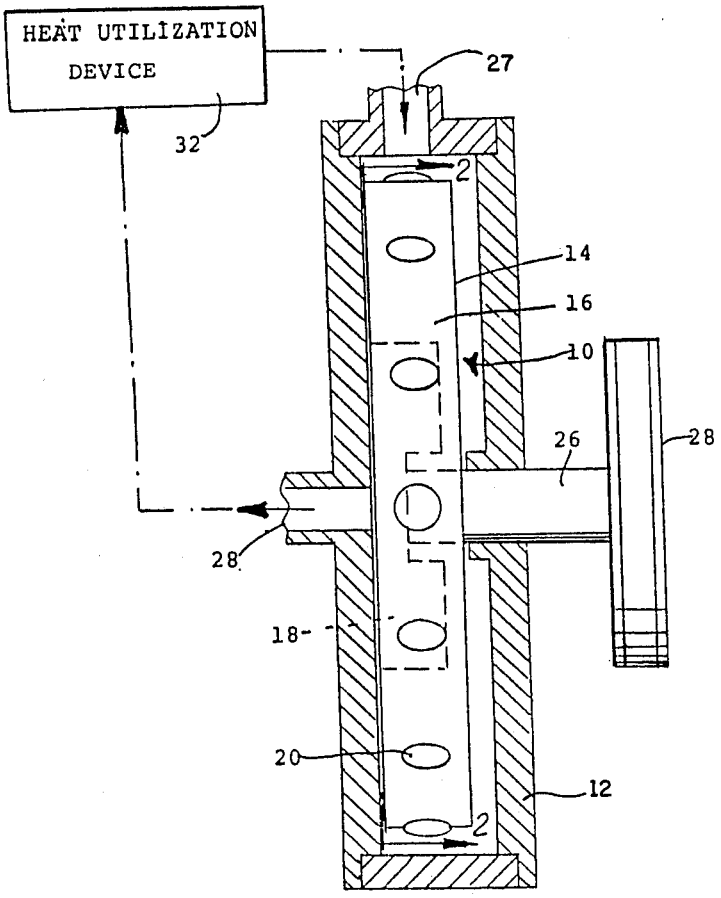
FIG. 1 is a vertical cross-sectional view showing the impeller of the invention mounted in a closed housing defining a liquid reservoir.
Figure 2:
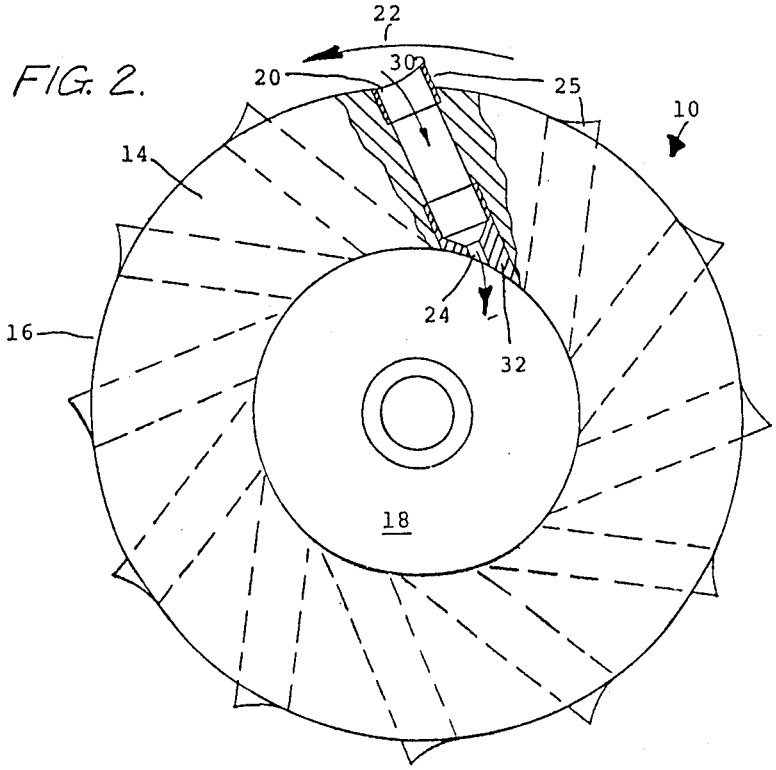
FIG. 2 is a view of the impeller looking in the direction of the arrows 2—2 FIG. 1.

Referring now to the drawings, the numeral 10 defines the impeller of the invention which is adapted to be disposed within a closed housing 12 defining a reservoir containing a heat transfer liquid. The impeller 10 comprises a rotor 14 having a peripheral surface 16 and a central outlet cavity 18 having an axial opening on one side while being closed on the other. Fluid passages 20 lead from the peripheral surface 16 of the rotor into the cavity 18, the passages 20 being arranged relative to the axis of rotation of the rotor that upon rotation thereof in a predetermined direction, as indicated by the arrow 22, liquid is forced to flow from the periphery of the rotor into the outlet cavity 18. Restricted orifices 24 are provided in each fluid passage proximate the outlet cavity 18 to cause liquid to be heated as it flows through the passages into the outlet cavity.

Though it is within the purview of the invention for the passages to define various longitudinal paths for liquid flow, desirably the passages are straight, as shown, and equiangularly spaced about the axis of rotation of the rotor, the longitudinal axis of the respective passages sloping relative to the axis of rotation in the same direction as the predetermined direction of rotation as indicated by arrow 22.

The entrances of the passages 20 at the peripheral surface 16 of the rotor are provided with scoops 25 which extend beyond the peripheral surface 16 and face in the same direction as the predetermined direction of rotation.

In its position of use the impeller 10 is mounted in the housing 12 on a shaft 26 which extends through a wall of the housing and may be driven in the predetermined direction 22 by any convenient power source represented generally by the pully 28. The housing 12 has an inlet port 30 connected to the outlet of a heat utilization device 32, such as a heat exchanger, and leading into the housing in substantially radial alignment with the rotor. The housing 12 also has an outlet port 28 in substantial axial alignment with the outlet opening of the outlet cavity and leading to the inlet of the heat utilization device.

Desirably the rotor body of the impeller is made of a light-weight substance such as aluminum or even plastic. However, such substances are subject to erosion as the rotor is driven at a high rate of rotational speed through the liquid. To counter this problem, the scoops 25 and the restricted orifices 24 are formed on or in inserts 30, 32, respectively, having a hardness to resist such erosion. Means are provided, such as screw threads (not shown) or an interference fit for rigidly connecting the inserts to the rotor proximate the inlets and outlets, respectively, of the passages.

In use, the described impeller of the invention has been found to heat the liquid to a high level in a short period of time with a high degree of efficiency and with no interruption in flow due to cavitation.

Having fully described the invention what is claimed is:

1. Apparatus for heating liquid comprising:

a. an impeller for disposition within a closed housing defining a reservoir for containing a heat transfer liquid said impeller comprising:

i. a cylindrical rotor having external surface including a peripheral surface said external surfaces being arranged for frictional engagement with liquid in said housing;

ii. a central outlet cavity; and iii. fluid passages leading from said peripheral surface into said outlet cavity; said passages being arranged relative to the axis of rotation of said rotor that upon rotation thereof in a predetermined direction liquid is forced to flow from the peripheral surface of said rotor into said outlet cavity; and restricted orifices in said fluid passages to cause liquid to be heated as it flows through said passages into said outlet cavity.

2. The apparatus of claim 1, including said closed housing, a rotatable shaft extending through a wall of said housing and drivingly connected to said impeller, said outlet chamber having an axial opening on one side of said rotor and being closed on the other side, an inlet port through the wall of said housing in substantial radial alignment with said rotor, and an outlet port through a wall of said housing in substantial axial alignment with the outlet opening of said outlet cavity.

3. The apparatus of claim 1, wherein said restricted orifices are proximate said outlet cavity.

4. The apparatus of claim 1, wherein said passages are equiangularly spaced about the axis of rotation of said rotor, said passages sloping relative to said axis of rotation from said outlet cavity toward said peripheral surface in the same direction as the predetermined direction of rotation of said rotor.

5. The apparatus of claim 4, wherein said passages are straight.

6. The apparatus of claim 4, wherein the entrances of said passages at said peripheral surfaces are provided with scoops extending beyond said peripheral surface and facing in said predetermined direction of rotation.

7. The apparatus of claim 6, wherein said scoops and said restricted orifices are formed on or in inserts composed of a substance having a hardness to resist erosion as said rotor is driven through liquid and means for rigidly connecting sasid inserts to said rotor proximate the inlets and outlets, respectively, of said passages.

* * * * *